US005797565A

United States Patent [19]

Tuningley et al.

[11] Patent Number: 5,797,565

[45] Date of Patent: Aug. 25, 1998

[54] RAILWAY DIAMOND CROSSING

[75] Inventors: Alan James Tuningley, Delta, Canada; Johannes Rainer Oswald, Zeltweg, Austria; Gary David Click, Brimingham, Ala.; Michael Brian Starkey, New Westminster; Tommy Lee, Surrey, both of Canada

[73] Assignee: VAE Nortrak North America, Inc., Richmond, Canada

[21] Appl. No.: 730,938

[22] Filed: Oct. 16, 1996

[51] Int. Cl.[6] ..... E01B 7/00

[52] U.S. Cl. ..... 246/465

[58] Field of Search ..... 246/454, 465, 246/466, 467, 111, 273, 375

[56] References Cited

U.S. PATENT DOCUMENTS

| | | | |
|---|---|---|---|
| 75,429 | 6/1868 | Chapin | 246/467 |
| 178,140 | 5/1876 | Gray et al. | 246/465 |
| 182,599 | 9/1876 | Pierce | 246/465 |
| 198,393 | 12/1877 | Johnston | 246/467 |
| 218,632 | 8/1879 | Jefferey | 246/465 |
| 359,116 | 3/1887 | Wharton | 246/465 |
| 950,287 | 2/1910 | Havard | 246/466 |
| 1,703,716 | 2/1929 | Botto | 246/466 |
| 1,743,924 | 1/1930 | Kopp . | |
| 1,811,129 | 6/1931 | Hesskew et al. | 246/467 |
| 2,132,008 | 10/1938 | Asselin | 246/465 |
| 2,539,529 | 1/1951 | Asselin | 246/467 |

*Primary Examiner*—Mark T. Le

*Attorney, Agent, or Firm*—Fulwider Patton Lee & Utecht

[57] ABSTRACT

A railway crossing, sometimes referred to as a diamond crossing, has four substantially identical crossing beams which have cutouts made for a wide range of crossing angles. At least two separate base plates are cut to fit the required crossing angle and positioned beneath the crossing beams. Each crossing beam has a flangeway groove extending along at least a portion of the beam length and each beam has integral rail shaped ends for connection to a standard rail section. The crossing beams have top cutouts and bottom cutouts that intersect and are set for a predetermined crossing angle. Boltless locator pins prevent horizontal movement of the top and bottom beams on the plates, and elastic fasteners hold the top and bottom beams to the plates to restrict vertical movement between the top and bottom beams and the plates.

13 Claims, 4 Drawing Sheets

RAILWAY DIAMOND CROSSING

TECHNICAL FIELD

The present invention relates to railway crossings and more particularly to a railway crossing formed from four substantially identical crossing beams that have cutouts made for any angle in a range of crossing angles.

BACKGROUND ART

Railway crossings, generally referred to as diamond crossings, occur where one railway line crosses over another. At the present time most railway crossings have to be individually designed because the crossing angles vary from one crossing to another. It has been found that in general no two crossings have the same crossing angle. This means that each and every crossing has to be custom designed and custom made. Railway crossings wear faster than continuous railway lines due to train wheels impacting at the crossing points. This generally results in the crossings having to be replaced or repaired frequently. As these crossings are custom designed, in other words are non-standard, then the costs of replacing or repairing crossing members are high.

Attempts have been made to make a standard railway crossing and one example is shown in U.S. Pat. No. 1,743,924 to Kopp. This patent shows solid rail sections, each one rectangular in cross-section with flangeway grooves therein and cutouts where two top rail members intersect with two bottom rail members. The rail members are attached to a single base plate and, as can be appreciated, the size of the plate is large and shipping a plate of this size to a site would be difficult. Furthermore, a large plate does not provide access to railway ties, so one is not able to get underneath the plate to provide the necessary compaction to support the crossing. Furthermore, Kopp shows the rail sections being attached to railroad ties by spikes that engage a bottom flange of the rail section, and pass through holes provided in the base plate. Thus, if the spikes become loose, the rail sections tend to separate from this base plate which can result in excessive movement causing wear and tear.

DISCLOSURE OF INVENTION

It has now been found that we can make a railway crossing using four substantially identical crossing beams which have cutouts made therein for any crossing angle in a range of crossing angles to suit each crossing requirement. We have also found that we can attach the crossing beams to at least two separate base plates cut to fit the required crossing angle, each plate supporting an individual top beam with the bottom beams extending across both plates. Thus, one is able to avoid having a single large base plate which makes for easier shipping and permits tamping at the crossing.

Another improvement in the railway crossing according to the present invention is having the ends of the crossing beams shaped to form a standard rail section and utilizing a welded rail connection between the crossing beams and standard rails.

A still further improvement in the present invention is providing locator pins to hold gauge and prevent racking between the crossing beams and the plates which are independent of the connections between the plate and the railway ties. Also spring clips are provided which restrict vertical movement between the plate and the crossing beams. The locator pins and the spring clips are completely independent of the connection between the base plates and the railway ties.

The present invention provides a railway crossing comprising four substantially identical crossing beams, each crossing beam having a flangeway groove extending along at least a portion of beam length, each crossing beam having integral rail shaped ends for connection to a standard rail section; two of the crossing beams, representing bottom beams for a first railway line, having top cutouts; the two remaining crossing beams, representing top beams for a second railway line, having bottom cutouts fitting over the top cutouts in the bottom beams, and flangeway grooves in the top surface thereof for the first railway line, the cutouts in the top and bottom beams set for a predetermined crossing angle; at least two base plates, shaped to the predetermined crossing angle, at least one of the two have plates positioned under one of the beams and a portion of another of the beams, and boltless locator pins preventing horizontal movement of the top and bottom beams on the plates, and elastic fasteners holding the top and bottom beams to the plates to restrict vertical movement between the top and bottom beams and the plates.

BRIEF DESCRIPTION OF DRAWINGS

In drawings which illustrate embodiments of the present invention.

BEST MODE FOR CARRYING OUT THE INVENTION

Figure 1:
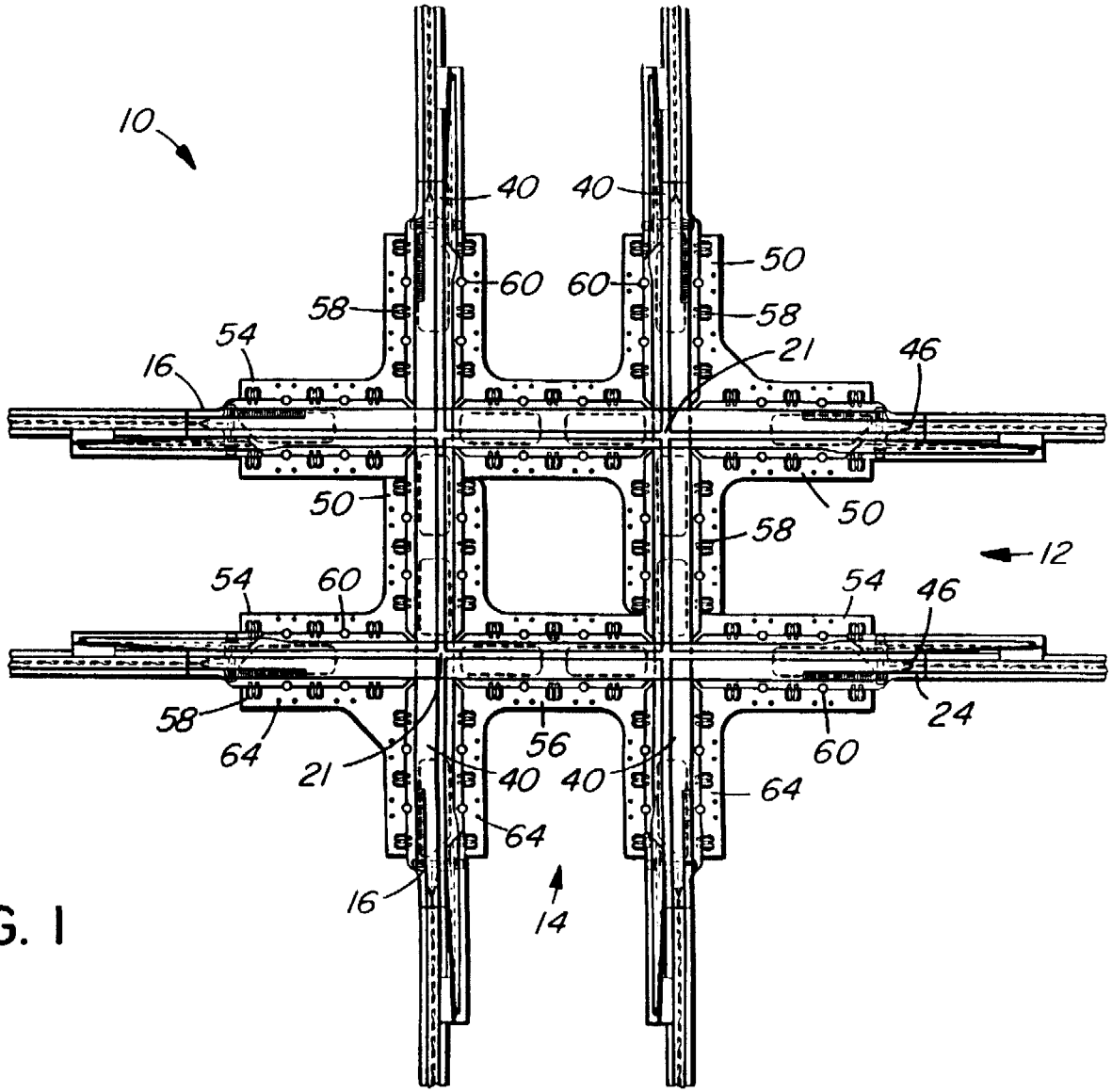
FIG. 1 is a top view showing a 90° railway crossing according to one embodiment of the present invention.
Figure 2:
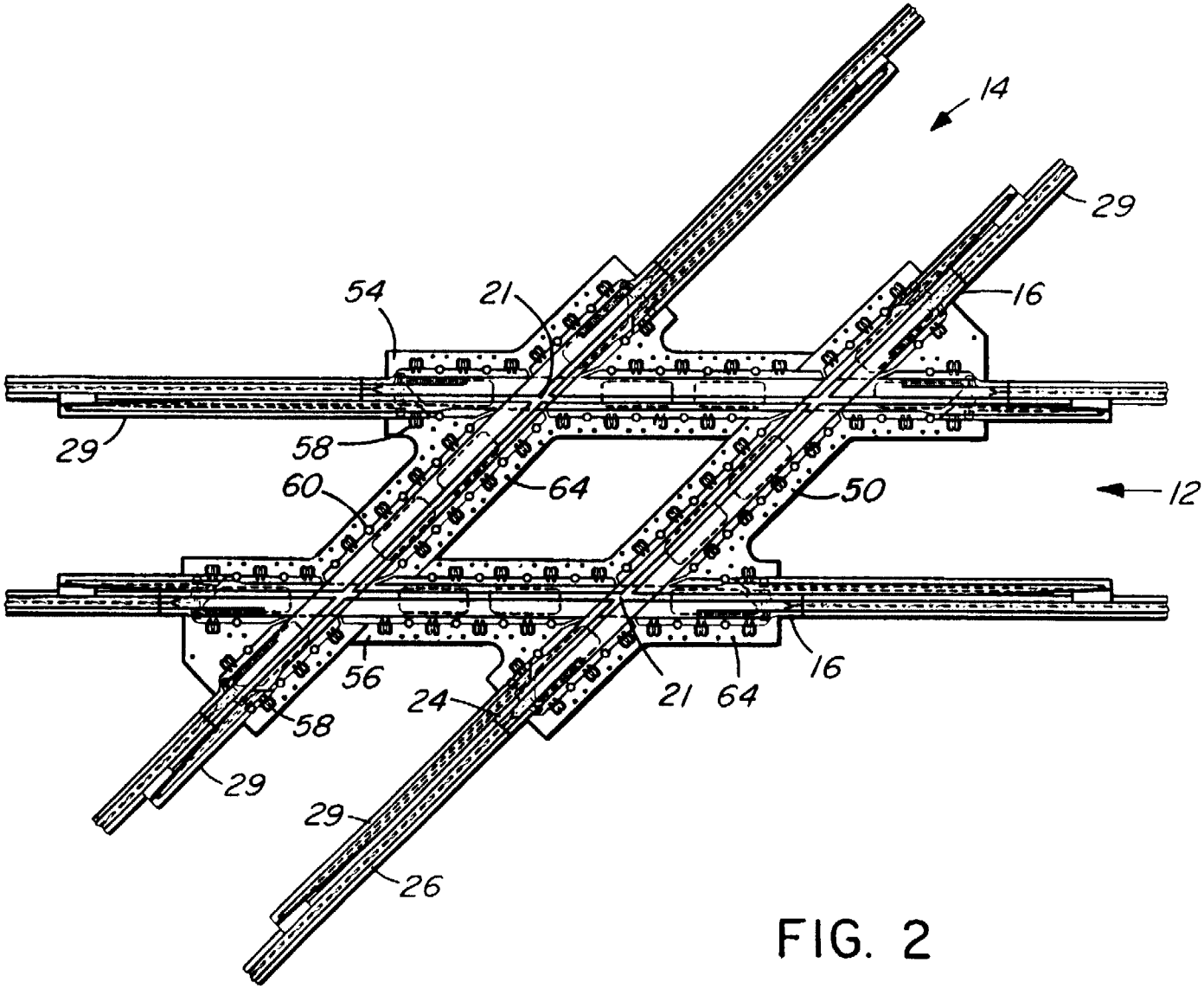
FIG. 2 is a top view showing a 45° railway crossing according to another embodiment of the present invention.

A railway crossing 10 is shown in FIG. 1 with a first railway line 12 at right angles to a second railway line 14. FIG. 2 shows another arrangement of a railway crossing referred to as a diamond crossing wherein the first railway line 12 is at 45° to the second railway line 14. Both the railway crossings shown in FIGS. 1 and 2 are made primarily of four substantially identical crossing beams 16 as shown in FIGS. 3 to 6. The crossing beams 16 are all the same length for a specific range of crossing angles, for example, one length of crossing beam 16 is suitable for crossing angles varying from 45° to 90°. A second length of crossing beam 16 is required for a crossing angle in the range of 10° to 45°.

The crossing beams 16 are made from wear resistant steel such as manganese steel, heat treated steel or bainitic steel. Other suitable steels may also be used. The beams 16 are cast and/or machined and have a substantially rectangular cross-sectional shape with bottom flanges 18 extending out from either side of the cross-sectional shape. On the top surface 19 of the beams 16 is a flangeway groove 20 which extends for a sufficient distance on the crossing beam so that the crossing position 21 where the rails cross always have the groove 20 and the flange protection portion 22. A rail shaped end portion 24 is formed at both ends of the crossing beams 16. This end portion 24, which is integral with the crossing beam 16 itself, has a cross-section that is identical to a standard rail section, thus can be connected to a standard rail 26. As shown in FIGS. 1 and 2, a short section of rail 26 is joined to the end section 24 by welding or bolting.

Figure 3:
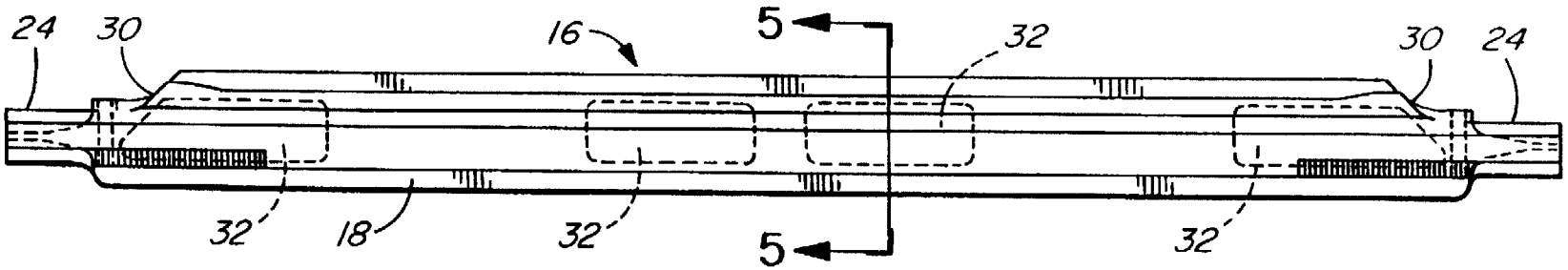
FIG. 3 is a top view showing a standard crossing beam according to one embodiment of the present invention.
Figure 4:
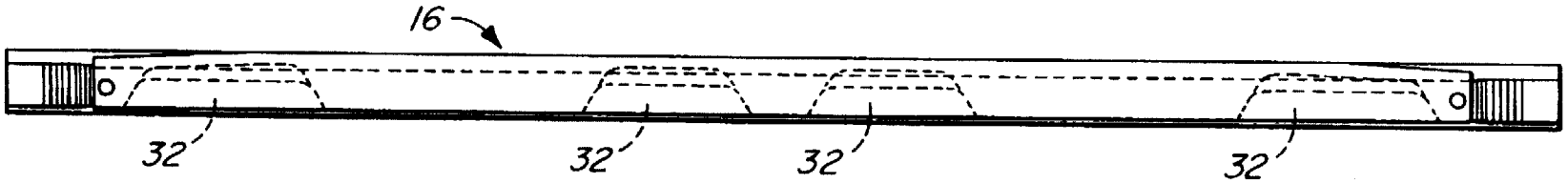
FIG. 4 is a side elevation showing the crossing beam of FIG. 3.
Figure 6:
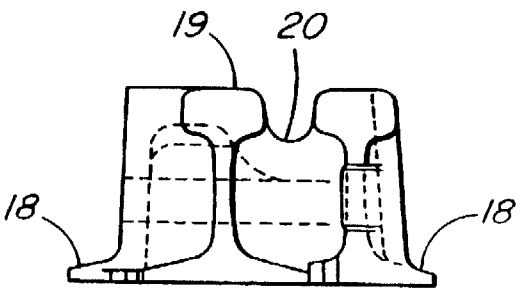
FIG. 6 is an end view showing the crossing beam of FIG. 4 taken at arrow A.
Figure 5:
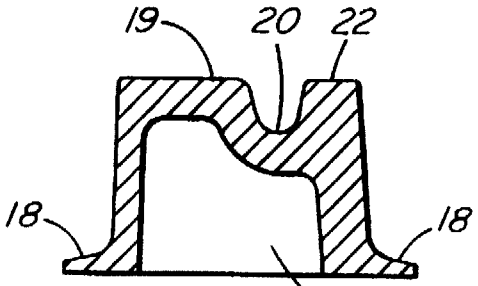
FIG. 5 is a sectional view taken at line 5—5 of FIG. 3.

At the end section 24 of each crossing beam 16 a guard rail 29 is shown attached which extends the flangeway groove 20 to a flared section 30. The flared section 30 on both railway lines are shown opposite each other so that train wheel rims on both rails enter the flared sections 30 at the same time. In railway crossings that have crossing angles less than 90°, the flared sections 30 are not necessarily opposite each other. Guard rails 29 may be used either on one side or both sides of the crossing beams 16. In some cases guard rails 29 are not used at all. They are generally made from standard rail sections. Hollow sections 32 on the underneath of the crossing beam 16 are provided in locations where cutouts are not going to be made for a specific range of crossing angles. As can be seen in FIGS. 3 and 4, four hollow sections 32 are shown. The purpose of the hollow sections 32 is primarily to reduce the weight of the crossing beam 19 thus reduce cost and allow easier handling of the unit.

Figure 7:
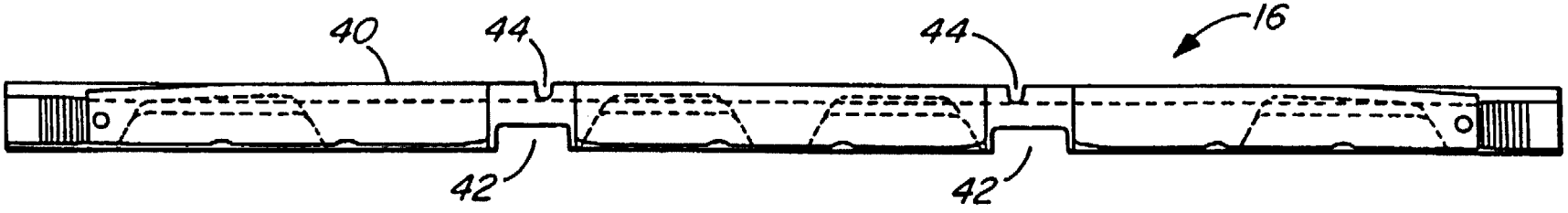
FIG. 7 is an elevational view showing a top crossing beam with bottom cutouts according to one embodiment of the present invention.
Figure 8:
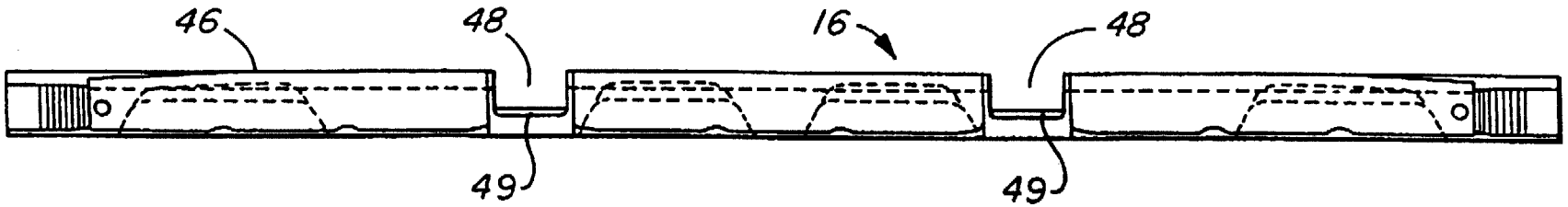
FIG. 8 is a side elevation showing a bottom crossing beam with top cutouts for matching the top crossing beam of FIG. 7.

Each crossing beam 16 has cutouts that match four beams together to form a railway crossing. Two of the crossing beams 16 are bottom beams which are connected to the secondary railway line and the other two beams are top beams which are connected to a main railway line. In each case the top and bottom beams are cut from a standard crossing beam similar to that shown in FIGS. 3 to 6. FIG. 7 shows a top crossing beam 40 which has bottom cutouts 42 for a 90° crossing angle. The crossing angle can be varied from 45° to 90° in one length and less than 45° for a longer crossing beam. The bottom cutouts 42 also have cuts through the flanges, for example a 45° cut for a 90° crossing as shown in FIG. 1. The bottom cutouts 42 have a sufficient depth to match the bottom beams. A crossing flangeway groove 44 is positioned on the top surface 19 of the top beam 40 for the railway crossing. A bottom beam 46 is shown in FIG. 8 with top cutouts 48 designed to receive the bottom cutouts 42 of the top beam 40 and having 45° cuts in the flanges 18 so a gap is left between the flanges 18 of the top beams 40 and the bottom beams 46. The surface 19 of the crossing beams are level at the crossing. Whereas the flanges 18 are shown having 45° cuts therein, this angle changes when the crossing angle is less than 90°. As shown in FIG. 2, the flanges are cut at different angles so there is always a gap left between the flanges 18 of the top beam 40 and the flanges 18 of the bottom beam 46. In one embodiment the depth of the top cutout 48 in the bottom beam 46 and the bottom cutout 42 in the top beam 40 is sufficient so that a small space exists between the cutouts when the crossing members are assembled. Thus, in this case the section of the top beam 40 acts as a bridge across the bottom cutout 48 with the full load of the wheel being carried on this bridge. In another embodiment the cutouts 42,48 are made so that the bottom cutout 42 in the top beam 40 rests on the top cutout 48 in the bottom beam 46. In this case the load is transferred through surface contact rather than the top beam 40 forming a bridge.

In yet a further embodiment a small space may be left between the cutouts and resilient material such as an elastomeric pad 49, as shown in FIG. 8, may be placed therein to evenly spread the load between the beams. Thus the top beam 40 would not act solely as a bridge, but the wheel load would be taken by both beams.

In one embodiment, two base plates 50 are provided underneath the crossing beams as shown in FIGS. 1 and 2. In FIG. 1 the base plates are shaped to a 90° crossing, whereas in FIG. 2 the base plates are shaped to a 45°. The base plates 50 are identical for one crossing angle and, as shown in FIG. 1, are arranged to pass completely under the top beam 40 and have extensions 52 to support a portion of both the bottom beams 46 extending outwards from the top beam 40, and an extension 54 to support one bottom beam 46 extending inwards to meet the adjacent plate 50. Both bottom beams 46 extend across the two plates 50 spanning the join between the plates. Thus, these plates 50 spread the load from the bottom crossing beams 46, but each plate supports the full load from the top crossing beam 40.

In other embodiments more than two plates may be supplied that are each positioned under one or two beams.

The crossing beams 16 are attached to the plates 50 by means of elastic fasteners such as spring clips 58. Different types of elastic fasteners are available in the market today. These spring clips 58 extend over the flanges 18 of the crossing beams 16 and allow restricted vertical movement between the crossing beams 16 and the plates 50. Two types of suitable spring clips 58 are PANDROL or SAFELOK, both names being registered trademarks. Other types of elastic fasteners may be used.

Locator pins 60 are provided to prevent horizontal movement between the crossing beams 16 and the plates 50. As shown in FIGS. 1 and 2 rods or tubular locking pins 60 extend up a short distance from holes in the plates 50 at convenient positions and fit into semi-circular grooves 62 cut in the flanges 18 of the crossing beams 16. The locator pins 60 are rigidly held to the plates 50. The locator pins 60 are provided on both sides of the crossing beams, thus horizontal or sideways movement is restricted. By the use of the locking pins 60 and the spring clips 58, the crossing beams 16 are firmly attached to the plates 50 without the use of bolts or spikes, and a cushioning is provided by the spring clips 58.

Attachment holes 64 in the plates 50 are shown in FIGS. 1 and 2 wherein the plates 50 are attached by bolts or spikes to railway ties (not shown) in the normal manner. In some instances the ties may be wood, in other instances concrete or other known materials may be provided. The actual attachment of the plates 50 to the rail supports is not considered part of the present invention.

In one embodiment, for crossing angles between 90° and 45° the overall length of the crossing beams 16 is 15 feet. This dimension is in no way limiting either to the length of the crossing beam 16 or to the crossing angle. As each crossing beam 16 is identical until the cutouts are made to represent top beams 40 and bottom beams 46, they become a standard item. To produce a railway crossing, four standard crossing beams 16 are taken from stock and cuts in the beams 16 are made at the required crossing angle to represent bottom cutouts 42 in the top beam 40 and top cutouts 48 in the bottom beam 46. The plates 50 are cutout to match the required crossing angle. The locator pins 60 are then inserted to position the top and bottom beams 40,46 in place on the plates 50 and the spring clips 58 are fitted to hold the beams 40,46 down. The assembly may be done on site to avoid the necessity of transporting large assemblies.

When the crossing angle is between approximately 10° and 45°, then the length of the crossing beams increases. For small crossing angles, then two crossing beams are provided per rail with a short rail length in between. The cutouts always occur in the crossing beams. Guard rails may be provided between crossing beams to extend the flangeway grooves for the full length of the crossing.

Whereas two top beams and two bottom beams have been disclosed herein, in another embodiment four identical crossing beams may be provided, each beam having one top cutout and one bottom cutout so that the beams notch together, each overlapping the other similar to folding the top flaps of a cardboard box.

Various changes may be made to the embodiments shown herein without departing from the scope of the present invention which is limited only by the following claims.

The embodiments of the present invention in which an exclusive property or privilege is claimed are defined as follows:

1. A railway crossing comprising:

four substantially identical crossing beams, each of said crossing beams having a flangeway groove extending along at least a portion of a beam length, each of said crossing beams having an integral rail shaped end for connection to a standard rail section;

two of the crossing beams, representing bottom beams for a first railway line, having top cutouts;

the two remaining crossing beams, representing top beams for a second railway line, having bottom cutouts fitting over the top cutouts in the bottom beams, and flangeway grooves in the top surface thereof for the first railway line, the cutouts in the top and bottom beams set for a predetermined crossing angle;

at least two base plates shaped to the predetermined crossing angle, at least one of the two plates positioned under one of the beams and a portion of another of the beams; and boltless locator pins preventing horizontal movement of the top and bottom beams on the plates and elastic fasteners holding the top and bottom beams to the plates to restrict vertical movement between the top and bottom beams and the plates.

2. The railway crossing according to claim 1 wherein each of said two base plates are positioned under one of the top beams and a portion of the bottom beams, the bottom beams extending across both of said base plates.

3. The railway crossing according to claim 2 wherein the two base plates are substantially identical.

4. The railway crossing according to claim 1 wherein the predetermined crossing angle is in the range of about 45° to 90°.

5. The railway crossing according to claim 1 wherein the predetermined crossing angle is in the range of about 10° to 45°.

6. The railway crossing according to claim 1 wherein the crossing beams have lower flanges on both sides.

7. The railway crossing according to claim 6 wherein the locator pins comprise tubular members attached to the plates, and projecting upward therefrom, and cutouts in the flanges on both sides of the crossing beams to engage the tubular members.

8. The railway crossing according to claim 6 wherein the elastic fasteners comprise spring clips attached to the plates, the spring clips extend over the flanges of the beams and provide limited vertical movement between the plates and the beams.

9. The railway crossing according to claim 1 wherein the crossing beams are cast or machined from wear resistant steel with a substantially rectangular cross-section, and are substantially solid with hollowed portions positioned where cutouts for said predetermined crossing angle do not occur.

10. The railway crossing according to claim 9 wherein the crossing beams are made from wear resistant steel selected from the group consisting of: heat treated steel, manganese steel, and bainitic steel.

11. The railway crossing according to claim 1 wherein the top cutouts in the bottom beams and the bottom cutouts in the top beams are arranged to have a space at the cutouts between the top beam and the bottom beam, thus the top beam forms a bridge at the cutouts.

12. The railway crossing according to claim 11 including resilient material in the space between the top beam and the bottom beam to evenly spread the load between the beams.

13. The railway crossing according to claim 1 wherein the integral rail shaped ends are welded to standard rails.

* * * * *

UNITED STATES PATENT AND TRADEMARK OFFICE

CERTIFICATE OF CORRECTION

PATENT NO. : 5,797,565

DATED : Aug. 25, 1998

INVENTOR(S) : Alan James Tuningley, Johannes Rainer Oswald, Gary David Click, Michael Brian Starkey, Tommy Lee It is certified that error appears in the above-identified patent and that said Letters Patent is hereby corrected as shown below:

Title page, "References Cited","U.S.PATENT DOCUMENTS", change "75,429", to read --78,429--.

Signed and Sealed this

Seventeenth Day of November, 1998

*Attest:*

Bruce Lehman

BRUCE LEHMAN

*Attesting Officer*

*Commissioner of Patents and Trademarks*